United States Patent [19]

Johnsen

[11] 4,139,411

[45] Feb. 13, 1979

[54] SYSTEM FOR FORMING AND TREATING A NARROW MULTI-LAYER WEB

[75] Inventor: Oystein Johnsen, Oslo, Norway

[73] Assignee: Myrens Verksted A/S, Oslo, Norway

[21] Appl. No.: 782,446

[22] Filed: Mar. 29, 1977

[30] Foreign Application Priority Data

Mar. 31, 1976 [NO] Norway ..... 761116

[51] Int. Cl.[2] ..... D21F 11/08

[52] U.S. Cl. ..... 162/123; 162/133; 162/194; 162/205; 162/269; 162/286; 162/304; 162/305

[58] Field of Search ..... 162/123, 194, 132, 133, 162/204, 205, 269, 286, 305, 304

[56] References Cited

U.S. PATENT DOCUMENTS 798,597 9/1905 Case ..... 162/123

1,049,423 1/1913 Wallace ..... 162/269

1,625,472 4/1927 Kelly ..... 162/286 X

*Primary Examiner*—Richard V. Fisher

*Attorney, Agent, or Firm*—Holman & Stern

[57] ABSTRACT

A continuous web of wood or cellulose pulp leaving a dewatering apparatus such as a suction mould or vat machine and having a relatively high content of water, is slitted in two or more longitudinal webs of approximately the same width. The narrow, slitted webs are turned so as to be parallel and brought together or gathered to a multilayer web which is narrower and thicker than the original web. This multilayer web is subjected to further dewatering in one or more pressing machines having dimensions adapted to those of the multilayer web. Finally, the multilayer web is cut transversely into sheets of appropriate size for stacking and packing in bales of suitable size.

5 Claims, 5 Drawing Figures

SYSTEM FOR FORMING AND TREATING A NARROW MULTI-LAYER WEB

BACKGROUND OF THE INVENTION

The present invention relates to a method of treating a continuous web of wood or cellulose pulp produced in a dewatering apparatus such as a suction mould and having a relatively high content of water.

The invention also relates to an apparatus for carrying out the method.

There is previously known a method of treating wood or cellulose pulp, in which the pulp leaving a suction mould in the form of a continuous web having a solids content of approximately 25 weight percent is passed directly into subsequent pressing means having the same operating width as the suction mould. In such a method the pulp web is freely suspended between the suction mould and the first pressing means and between the various pressing means. Thus, a required tensioning of the web is achieved, which counteracts a skew pulling of the web in the pressing means. If the web is made of cellulose mass, which forms a stronger web than a wood pulp, the web may be tensioned by means of a transverse roller resting on the web. After the pulp web has passed the pressing means, including grooved rollers, it may, for example, have a solids content of approximately 50 percent depending on the number of pressing sections it has gone through and the pressing pressure at which the rollers have been set. Then the web is slitted longitudinally in two or more narrower pulp webs which thereupon are placed on top of each other and severed transversely into suitable sheet sizes. These sheet layers are then stacked into suitable heights for later bundling in bales which may either be stored or conveyed to paper plants in which the pulp is subsequently ground and treated in paper machines.

The previously known method is encumbered with some disadvantages. Firstly, it requires a great operating staff, the starting up of the process requiring three operators. One operator must control the speed and two must carry out the threading of the pulp web through the machine. Due to the relatively large width of the web, a skew pulling of the web concurring rupture thereof during the threading operation may easily occur, requiring another threading of the web in the machine and, accordingly, loss of production time. The large width of the web also requires large pressing means, and the rollers which perform the pressing operation, must be of a robust design having a larger diameter in the middle area due to deformation, and having bearings which must withstand high loads.

SUMMARY OF THE INVENTION

The object of the present invention is to arrive at a method in which the above mentioned disadvantages are reduced to a minimum.

In other words, the object of the invention is to give directions for a method which is reliable and requires a minimum of operating staff, the apparatus used for carrying out the method comprising equipment requiring less space, lending itself to a more robust design without additional cost and requiring a minimum of service and maintenance.

In a method as defined initially, these object are achieved according to the invention by slitting the pulp web into two or more longitudinal webs immediately after leaving the suction mould, bringing together or gathering the resulting narrower webs to a narrower multilayer web for further dewatering and final transverse cutting to appropriate sheet dimensions for stacking and packing into bales.

More specifically, the method according to the invention comprises the following steps (a) slitting the pulp web immediately after leaving the suction mould into two or more longitudinal webs of approximately the same width, (b) turning the slitted, narrower webs so as to be parallel and gathering them to a narrower and thicker multilayer web, (c) subjecting the narrower and thicker multilayer web to further dewatering in one or more pressing means having dimensions adapted to those of the multilayer web, and (d) cutting the multilayer web into sheets of appropriate size for stacking and packing into sheet bales of suitable size.

The method according to the invention excels in a minimum requirement of staff, only one operator being necessary for the starting up of the process. The method according to the invention entails a very reliable process, since the narrower pulp webs may be supported between the various operational steps in a reliable and very convenient manner because a tensioning of the web is not necessary for the narrow, but thick multilayer web. The process is therefore less sensitive to skew pulling, and during normal operation only infrequent control is necessary. Due to smaller working widths of the apparatus for carrying out the method requires less space, which also results in a less costly installation. In addition, the installation will be simpler to maintain.

According to the invention an apparatus for carrying out the present method according to the invention may comprise (a) a slitting and gathering means for longitudinal slitting of said pulp web and gathering of the slitted, narrow webs to layers, said means being positioned in direct association with said suction mould, (b) one or more pressing means dimensioned for handling the narrow multilayer web to compress the layered web and squeeze further quantities of water from said web, and (c) a means for transverse cutting of the pressed narrow web layers and stacking thereof into suitable heights.

The novel apparatus or uptaking machine uses smaller and more convenient pressing devices than previously known uptaking machines for the same output. The pressing devices required according to the invention will have a substantially lower initial cost due to the fact that the length of the press rollers are reduced to say one fourth. It is true that since the compound web consists of say four layers rather than one, the press rollers used in the narrow pressing devices must have deeper grooves for the water pressed from the web to escape, but such a shape of the press rollers will not lead to higher machining costs compared with longer rolls operating on thinner web layers. In any case, the reduced dimensions and thereby the savings in material expenses, as well as a simpler mounting of the short rollers will contribute to the fact that the uptaking apparatus according to the invention is a more profitable investment than known apparatus for this purpose. Besides, the costs of operation of the uptaking apparatus according to the invention will become substantially reduced due to the reduced staff required for starting up, operation and maintenance.

In the following the invention will be described by reference to the drawing, which illustrates a conventional apparatus and an embodiment of an apparatus according to the invention.

DETAILED DESCRIPTION OF THE PREFERRED EMBODIMENT

Figure 1:
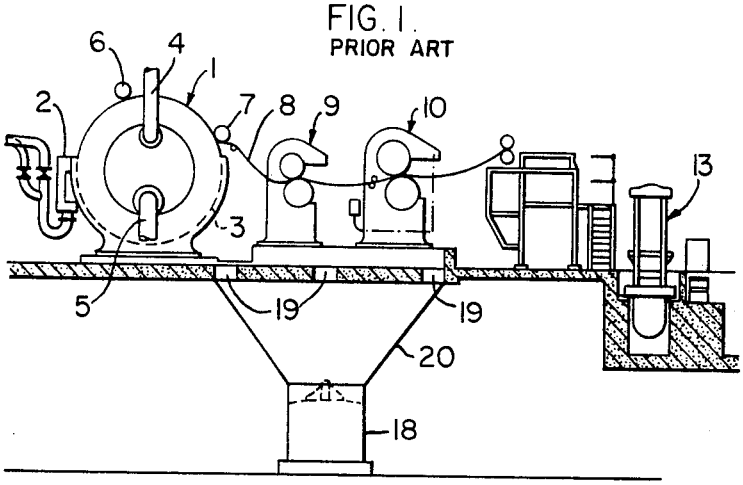
FIG. 1. PRIOR ART
FIGS. 1 and 2 are a side view and a top view, respectively, of an embodiment of a conventional apparatus for treating wood or cellulose pulp.
Figure 2:
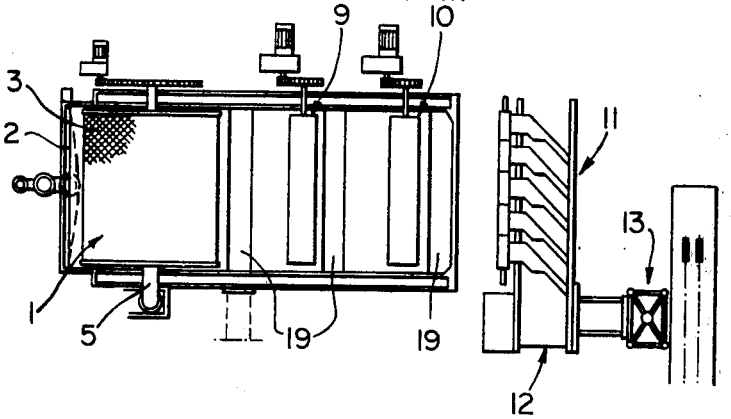
FIG. 2. PRIOR ART

In FIGS. 1 and 2, which illustrate an embodiment of a known apparatus for taking up or sheet-forming wood pulp or cellulose pulp, 1 is the general designation of a suction mould which via a supply chamber 2 receives wood or cellulose pulp having a solids content of approximately 0.7–2 percent. The supplied pulp deposits on the rotating wire drum 3 of the suction mould, said suction mould being subjected to a subatmospheric pressure by evacuation of air through a pipe 4. Removed liquid is drained from the suction mould through a discharge pipe. The supplied pulp deposits on the wire drum 3 of the suction mould as a continuous pulp web which is pressed by a press roller 6 and removed from the suction mould by means of a take-off roller 7. Due to the properties of the wood pulp or cellulose pulp, the maximum thickness of the pulp web on the suction mould will be approximately 7 millimeters for wood pulp and approximately 14 millimeters for cellulose pulp. To achieve a high production of pulp web it is therefore necessary to use suction moulds which can operate with relatively large pulp widths such as 3.5–5 meters. As indicated at 8, the pulp web is passed from the suction mould 1 to a subsequent pressing plant consisting of two pressing devices 9 and 10, respectively, whereafter it is passed into a combined slitting and gathering device 11 which slits the pulp web longitudinally in narrower pulp webs and gathers the slitted webs to superposed layers for further conveyance to a cutting station 12, in which the layered webs are cut into sheets of appropriate sizes and thereafter passed to a combined device 13 which presses and wraps the finished webs.

As indicated in FIG. 1, the continuous pulp web 8 is passed from the suction mould 1 to the pressing device 9, then to the pressing device 10 and further to the slitting and gathering device 11 without any form of support. If desired, the web 8 may be tensioned by means of tensioning rollers (not shown), the tensioning thereof being controlled by means of weights (not shown). Between the above described devices the web 8 is passed without being supported in order to provide the necessary tensioning of the web, thereby resisting a skew pulling of the web in the pressing devices. Due to the large width of the web 8, there can, even if the web is appropriately tensioned, nevertheless occur a skew pulling and therefore a rupture of the web. Such a rupture requires another threading of the web 8, resulting in lost production time and ineffective use of labour. Usually such known plants comprise a pulper which repulps the portions of the pulp web which are lost upon rupture, and in FIG. 1 such a pulper 18 is indicated below the suction mould 1 and the pressing device 9 and 10. Reject is supplied to the pulper through slots 19 provided in the areas in which the risk of rupture of the web is largest. The reject passed through the slots 19 is caught by a funnel 20 which leads it to the pulper 18. During starting of this known plant, which is illustrated in FIGS. 1 and 2, all of three men are required. One operator must control the speed and two operators must carry out the threading of the pulp web through the machinery, i.e. through the pressing devices 9 and 10 and the slitting and gathering device 11. During normal operation continuous monitoring is required, and even if this can be accomplished by one man only, two further men must be available in case a rupture of the pulp web should occur.

Besides from requiring a large staff, not only for the starting and restarting upon rupture, but also for frequent servicing and maintenance, such a known plant for taking up wood pulp also requires the press rollers included in the pressing devices 9 and 10, to have a robust construction with their largest diameter in the mid area because of the deformation and to have bearings which can resist heavy loads since the rollers have the same length as the width of the suction mould. The relatively large dimensions of the press rollers also result in large space requirements, which adds to the magnitude of the installation and building costs.

Figure 3:
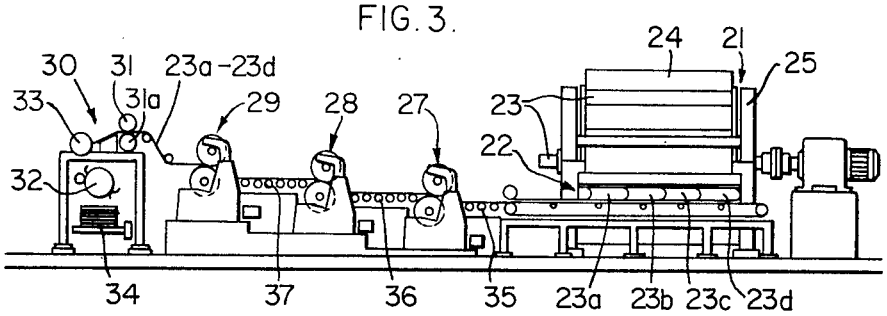
FIGS. 3 and 4 are a side view and a top view, respectively, on a larger scale of an embodiment of an apparatus according to the invention.
Figure 4:
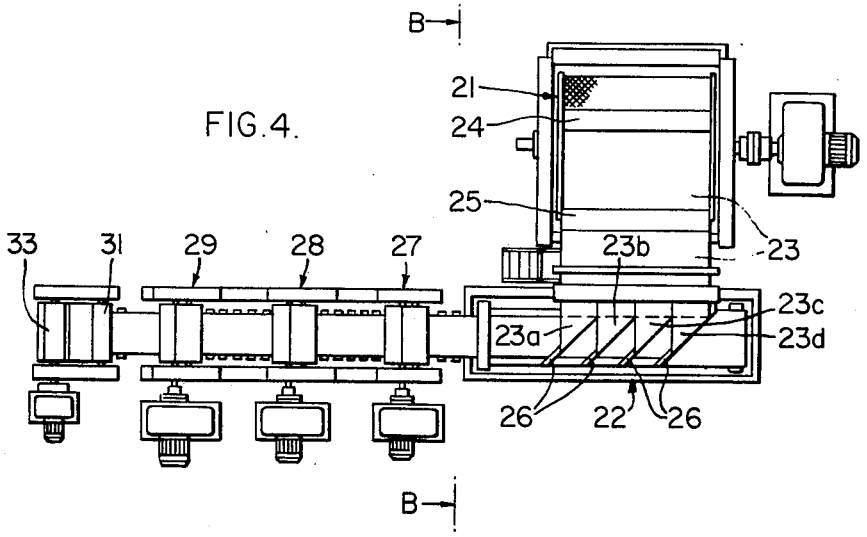
Figure 5:
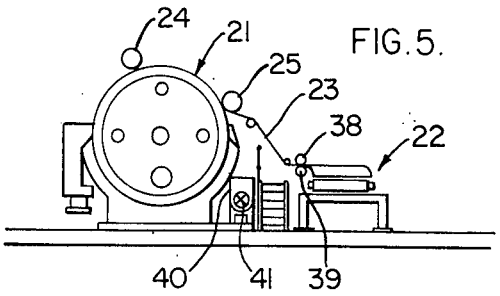
FIG. 5 is a section taken along line B—B in FIG. 4.

In the apparatus or plant according to the invention, of which an embodiment is illustrated in FIGS. 3–5, the above mentioned disadvantages are reduced to a minimum. Also this apparatus includes a suction mould 21 of the same type as the one described in connection with FIGS. 1 and 2, and the plant also includes a slitting and gathering device 22, for example of the type described above.

However, in the apparatus in FIGS. 3–5 the slitting and gathering device 22 is positioned close to the suction mould 21, so that a pulp web 23, which is formed in the suction mould and passes a press roller 24 and leaves the suction mould via a take-off roller 25, is passed directly into the slitting and gathering device 22, supported, if desired, by a suitable sliding surface, roller coaster or conveyor. In the device 22 the continuous web 23 is slitted into four narrower webs **23*a*, 23*b*, 23*c* and 23*d*, which by guiding boards 26 or rollers are turned approximately 90 degrees so as to be parallel and gathered together in layers before leaving the device 22, whereupon they are passed through a subsequent pressing plant consisting of one or more pressing devices. In FIGS. 3 and 4 three pressing devices 27, 28 and 29 are shown, and following the last device 29 there is a combined cutting and stacking device 30. This device consists of a pair of haul-off rollers 31 and 31*a* passing the pressed and further dewatered pulp webs 23*a*–23*d* into the area of take-off roller 32, where the webs are periodically acted upon by a knife roller 33 which cuts the pressed web layers into sheets of an appropriate size, whereafter the sheets are engaged by the take-off roller 32 and stacked to a pile of suitable height, such as indicated at 34**, whereupon the pile is wrapped and removed for storage or transport.

In the apparatus according to the invention a tensioning of the pulp web is not necessary when fed into the pressing device 27, 28 and 29, the narrow and thick multilayer web not being subjected to a skew pulling to the same extent as a broader, thinner, single web. Thus, the narrower compressed webs **23*a*–23*d* can be guided between the various devices by coaster rollers or conveyor belts as indicated at 35, 36 and 37. Thereby, a good support of the compressed pulp webs is achieved, a fact which together with the reduced width of the pulp webs provides a process in which the risk of breakage is a minimum. As illustrated in FIG. 5, the distance across which the full width of the pulp web 23 passes, is limited to the distance between the take-off roller 25 of the suction mould 21 and guiding rollers 38, 39 of the slitting and gathering device 22, whereas the full width of the pulp web 8 is retained for a substantially longer total distance in the apparatus shown in FIGS. 1 and 2. Thus, in the apparatus in FIGS. 3–5 the area in which the pulp web has the same width as the suction mould has been minimized. As indicated in FIG. 5, a receiving trough 40 which is connected to a pulper 41** is provided in this area, but practice has proven that such a pulper is used practically only during the starting up period, since when the pulp web during the starting up of the process has obtained a consitency which is suitable for further treatment of the web in the subsequent slitting and gathering stations and pressing stations, it is only to a small extent subjected to skew pulling and concurrent breakage.

In the apparatus of FIGS. 3–5 the threading of the pulp web can be carried out by a single operator, the further threading of the web after threading through the slitting and gathering device being easily effected because of its narrow width and the excellent support by the conveyor rollers or belts.

During starting of the apparatus according to FIGS. 3–5, the formed pulp web is first passed down into the pulper 40, in which it is finely divided and recirculated to the suction mould 21. When the pulp web has achieved a suitable consistency, water jets from two adjustable spraying nozzles (not shown) in the area of the take-off roller, will cut out a central web of suitable width. This central web is then threaded into the slitting and gathering device 22, in which it is slitted along its centre into two narrower webs. The two narrower webs are turned in the device and leave the device in a gathered state, whereafter they are threaded into the subsequent pressing devices. Then, the two spraying nozzles are moved apart towards the edges of the pulp web leaving the suction mould, so that eventually four narrower webs are formed. These webs are turned 90 degrees in the device and leave the device as superimposed layers.

It will be understood that in the uptaking apparatus according to the invention a greater or lesser number of pressing devices may of course be used, depending on the desired solids content of the finished web sheets. This is true also with respect to the known apparatus described in connection with FIGS. 1 and 2.

What I claim is:

1. A method of treating a continuous web of wood or cellulose pulp leaving a dewatering apparatus and having a solids content of approximately 25%, said pulp web being pressed for further dewatering and slitted and cut to bales of sheets of suitable size, characterized by slitting the pulp web in two or more longitudinal webs immediately after leaving the dewatering apparatus, bringing together or gathering the resulting narrower webs to a narrower multilayer web for further dewatering and final transverse cutting to appropriate sheet dimensions for stacking and packing into bales.

2. A method as claimed in claim 1, comprising the following steps:

(a) slitting the pulp web immediately after leaving the dewatering apparatus into two or more longitudinal webs of approximately the same width, (b) turning the slitted narrower webs so as to be parallel to each other and gathering them to a narrower and thicker miltilayer web, (c) subjecting the narrower and thicker multilayer web to further dewatering in one or more pressing means having dimensions adapted to those of the multilayer web, and (d) cutting the multilayer web into sheets of appropriate size for stacking and packing into sheet bales of suitable size.

3. A method as claimed in claim 1, wherein the pulp web is supported over most of the length over which the steps of the method are carried out.

4. An apparatus for carrying out a method of treating a continuous web of wood or cellulose pulp leaving a dewatering apparatus, and having a solids; content of 25%, comprising:

(a) a slitting and gathering means for longitudinal slitting of said pulp web and gathering of the slitted, narrow webs to layers, said slitting and gathering means being positioned in direct association with said dewatering apparatus, (b) one or more pressing means dimensioned for handling the narrow multilayer web to compress the layered web and squeeze further water from said web, and (c) a means for transverse cutting of the pressed narrow web layer and stacking thereof into suitable height.

5. An apparatus as claimed in claim 4, characterized by conveyor rollers or belts for supporting the web layers provided between the slitting and gathering means and the pressing means.

* * * * *